US006812815B2

(12) United States Patent
Simms et al.

(10) Patent No.: US 6,812,815 B2
(45) Date of Patent: Nov. 2, 2004

(54) REMOTELY CONTROLLABLE CIRCUIT BREAKER INCLUDING BYPASS MAGNET CIRCUIT

(75) Inventors: Kevin A. Simms, Houston, PA (US); Edward E. Lias, Aliquippa, PA (US); Jeffrey W. Lockhart, Pittsburgh, PA (US); Michael J. Erb, Fombell, PA (US)

(73) Assignee: Eaton Corporation, Cleveland, OH (US)

( * ) Notice: Subject to any disclaimer, the term of this patent is extended or adjusted under 35 U.S.C. 154(b) by 5 days.

(21) Appl. No.: 10/405,734

(22) Filed: Apr. 2, 2003

(65) Prior Publication Data

US 2004/0196123 A1 Oct. 7, 2004

(51) Int. Cl.[7] ..... H01H 83/00
(52) U.S. Cl. ..... 335/6; 335/18; 335/20
(58) Field of Search ..... 335/6–46, 147, 335/167–170, 230–236

(56) References Cited

U.S. PATENT DOCUMENTS 4,288,771 A * 9/1981 Ueda et al. ..... 335/230
6,259,339 B1 7/2001 Simms et al.
6,388,858 B1 5/2002 Simms et al.
6,507,255 B1 1/2003 Ennis et al.
6,714,108 B1 * 3/2004 Simms et al. ..... 335/6

* cited by examiner

*Primary Examiner*—James R. Scott
(74) *Attorney, Agent, or Firm*—Martin J. Moran

(57) ABSTRACT

A remotely controllable circuit breaker includes main contacts, secondary contacts and an arc plate drawing an arc from a fixed main contact when an operating mechanism opens the main contacts. A primary circuit electrically connects the main and secondary contacts between line and load terminals. A solenoid actuator selectively moves the secondary contacts between open and closed states. A magnetic bypass circuit is electrically connected between the arc plate and the load terminal. A movable magnetic armature cooperates with a fixed magnetic armature and is coupled to a movable arm controlled by the actuator. The circuits pass between the magnetic armatures, which respond to short circuit current flowing in the primary circuit and to arcing current flowing in the magnetic bypass circuit, in order to hold the secondary contacts in the closed state during both current conditions.

24 Claims, 7 Drawing Sheets

REMOTELY CONTROLLABLE CIRCUIT BREAKER INCLUDING BYPASS MAGNET CIRCUIT

CROSS-REFERENCE TO RELATED APPLICATION

This application is related to commonly assigned, concurrently filed U.S. patent application Ser. No. 10/405,894, filed Apr. 2, 2003, now U.S. Pat. No. 6,714,108, entitled "Circuit Breaker Including Mechanism for Breaking Tack Weld".

BACKGROUND OF THE INVENTION

1. Field of the Invention

This invention relates to circuit breakers for protecting electric power circuits and, more particularly, to remotely controllable circuit breakers including a set of secondary contacts, which can be remotely controlled.

2. Background Information

Circuit breakers used in residential and light commercial applications are commonly referred to as miniature circuit breakers because of their limited size. Such circuit breakers typically have a set of separable contacts opened and closed by a spring powered operating mechanism. A thermal-magnetic trip device actuates the operating mechanism to open the separable contacts in response to persistent overcurrent conditions and to short circuit conditions.

Usually, circuit breakers of this type for multiple circuits within a residence or commercial structure are mounted together within a load center, which may be located in a basement or other remote location. In some applications, it has been found convenient to use the circuit breakers for purposes other than just protection, for instance, for load shedding. It is desirable to be able to perform this function remotely, and even automatically, such as with a computer.

When a remotely controlled set of contacts, such as a set of secondary contacts, are in series with a circuit breaker, such as one having a set of main contacts, at certain voltage and current values it is necessary to control the blow off of the former contacts during short circuit conditions. For example, U.S. Pat. No. 6,259,339 discloses that in order for the set of secondary contacts to withstand short circuit currents and allow the set of main contacts to perform the circuit interruption, the magnet force generated by the short circuit current causes a movable armature mounted on a secondary contact arm to be attracted to a fixed pole piece seated in a molded housing, thereby clamping the secondary contacts closed.

There is room for improvement in circuit breakers and in remotely controllable circuit breakers employing a set of secondary contacts.

SUMMARY OF THE INVENTION

These needs and others are met by the present invention, which provides improvements in controlling the blow off of a set of secondary contacts during certain fault conditions, such as a short circuit condition.

In accordance with the invention, first and second magnetic armatures respond to a first predetermined condition of current flowing through a first circuit, which electrically connects a set of first contacts to a set of second contacts. These armatures cooperate to hold such set of second contacts in a closed state during such first predetermined condition of current. Furthermore, the first and second magnetic armatures respond to a second predetermined condition of current flowing in a second circuit, which electrically connects an arc plate associated with the set of first contacts and a second or load terminal. The armatures cooperate to hold such set of second contacts in the closed state during such second predetermined condition of current. In this manner, the first and second magnetic armatures respond through the first circuit to prevent blow off of the set of second contacts during initial fault or short circuit conditions, and the second circuit continues to prevent such blow off as the set of first contacts is opened by causing arcing current to be diverted from the arc plate and through the second circuit.

As one aspect of the invention, a circuit breaker comprises: a housing; a first terminal; a second terminal; a set of first contacts mounted in the housing; an operating mechanism mounted in the housing and coupled to the set of first contacts for opening and closing the set of first contacts; an arc plate drawing an arc from one of the first contacts when the operating mechanism opens the set of first contacts; a set of second contacts mounted in the housing, the set of second contacts having an open state and a closed state, and being electrically interconnected with the set of first contacts between the first and second terminals; a first circuit electrically connecting the set of first contacts to the set of second contacts; an actuator mounted in the housing, the actuator selectively moving the set of second contacts between the open and closed states; a second circuit electrically connected between the arc plate and the second terminal; a first magnetic armature coupled to the actuator; and a second magnetic armature, with the first and second circuits passing between the first and second magnetic armatures, the first magnetic armature and the second magnetic armature responsive to a first predetermined condition of current flowing in the first circuit and cooperating to hold the set of second contacts in the closed state during the first predetermined condition of current flowing in the first circuit, the first magnetic armature and the second magnetic armature responsive to a second predetermined condition of current flowing in the second circuit and cooperating to hold the set of second contacts in the closed state during the second predetermined condition of current flowing in the second circuit.

The first circuit may comprise a U-shaped conductor including a first leg electrically interconnected with the set of first contacts and a second leg electrically interconnected with the set of second contacts, with one of the first and second legs passing between the first and second magnetic armatures.

The set of first contacts may comprise a fixed contact electrically connected to the first terminal and a movable contact, the operating mechanism may comprise a movable arm carrying the movable contact, and the arc plate may draw the arc from the fixed contact when the movable arm opens the set of first contacts.

The movable arm may be a first movable arm, the fixed contact may be a first fixed contact, the movable contact may be a first movable contact, the set of second contacts may include a second fixed contact and a second movable contact, the actuator may comprise a second movable arm carrying the second movable contact, the first circuit may comprise a first flexible conductor electrically connected to the first movable arm, an intermediate conductor electrically connected to the first flexible conductor, and a second flexible conductor electrically connected between the intermediate conductor and the second movable arm. The second flexible conductor may pass from the intermediate conductor and between the first and second magnetic armatures before being electrically connected to the second movable arm.

The movable arm may be a first movable arm, the fixed contact may be a first fixed contact, the movable contact may be a first movable contact, the set of second contacts may include a second fixed contact and a second movable contact, the actuator may comprise a second movable arm carrying the second movable contact, and the first circuit may comprise at least one conductor electrically connected between the first movable arm and the second movable arm. One of the at least one conductor may be a flexible conductor, which passes between the first and second magnetic armatures before being electrically connected to the second movable arm. The first circuit may comprise a flexible conductor, which is electrically interconnected with the first movable arm, and a U-shaped conductor including a first leg electrically connected to the flexible conductor and a second leg electrically interconnected with the second movable arm, with one of the first and second legs passing between the first and second magnetic armatures.

As another aspect of the invention, a remotely controllable circuit breaker comprises: a housing; a first terminal; a second terminal; a set of first contacts mounted in the housing; an operating mechanism mounted in the housing and coupled to the set of first contacts for opening and closing the set of first contacts; an arc plate drawing an arc from one of the first contacts when the operating mechanism opens the set of first contacts; a set of second contacts mounted in the housing, the set of second contacts having an open state and a closed state, and being electrically interconnected with the set of first contacts between the first and second terminals; a first circuit electrically connecting the set of first contacts to the set of second contacts; a remotely controllable solenoid including a member coupled to the set of second contacts, the member movable to a first position in which the set of second contacts is in the open state and a second position in which the set of second contacts is in the closed state; a second circuit electrically connected between the arc plate and the second terminal; a first magnetic armature coupled to the member, and a second magnetic armature, the first and second circuits passing between the first and second magnetic armatures, the first magnetic armature and the second magnetic armature responsive to a first predetermined condition of current flowing in the first circuit and cooperating to hold the set of second contacts in the closed state during the first predetermined condition of current flowing in the first circuit, the first magnetic armature and the second magnetic armature responsive to a second predetermined condition of current flowing in the second circuit and cooperating to hold the set of second contacts in the closed state during the second predetermined condition of current flowing in the second circuit.

The second circuit may comprise a first conductor and a second flexible conductor, the second flexible conductor being electrically connected between the arc plate and the first conductor, the first conductor being electrically connected to the second terminal.

As another aspect of the invention, a circuit breaker comprises: a housing; a first terminal; a second terminal; a set of first contacts mounted in the housing; an operating mechanism mounted in the housing and coupled to the set of first contacts for opening and closing the set of first contacts; a set of second contacts mounted in the housing, the set of second contacts having an open state and a closed state, and being electrically interconnected with the set of first contacts between the first and second terminals; a circuit electrically connecting the set of first contacts to the set of second contacts; an actuator mounted in the housing, the actuator selectively moving the set of second contacts between the open and closed states; a first magnetic armature coupled to the actuator; and a second magnetic armature, with the circuit passing between the first and second magnetic armatures for at least two turns, the first magnetic armature and the second magnetic armature responsive to a predetermined condition of current flowing in the circuit and cooperating to hold the set of second contacts in the closed state during the predetermined condition of current flowing in the circuit.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "coupled" together shall mean that the parts are joined together either directly or joined through one or more intermediate parts. Further, as employed herein, the statement that two or more parts are "attached" shall mean that the parts are joined together directly.

Figure 1:
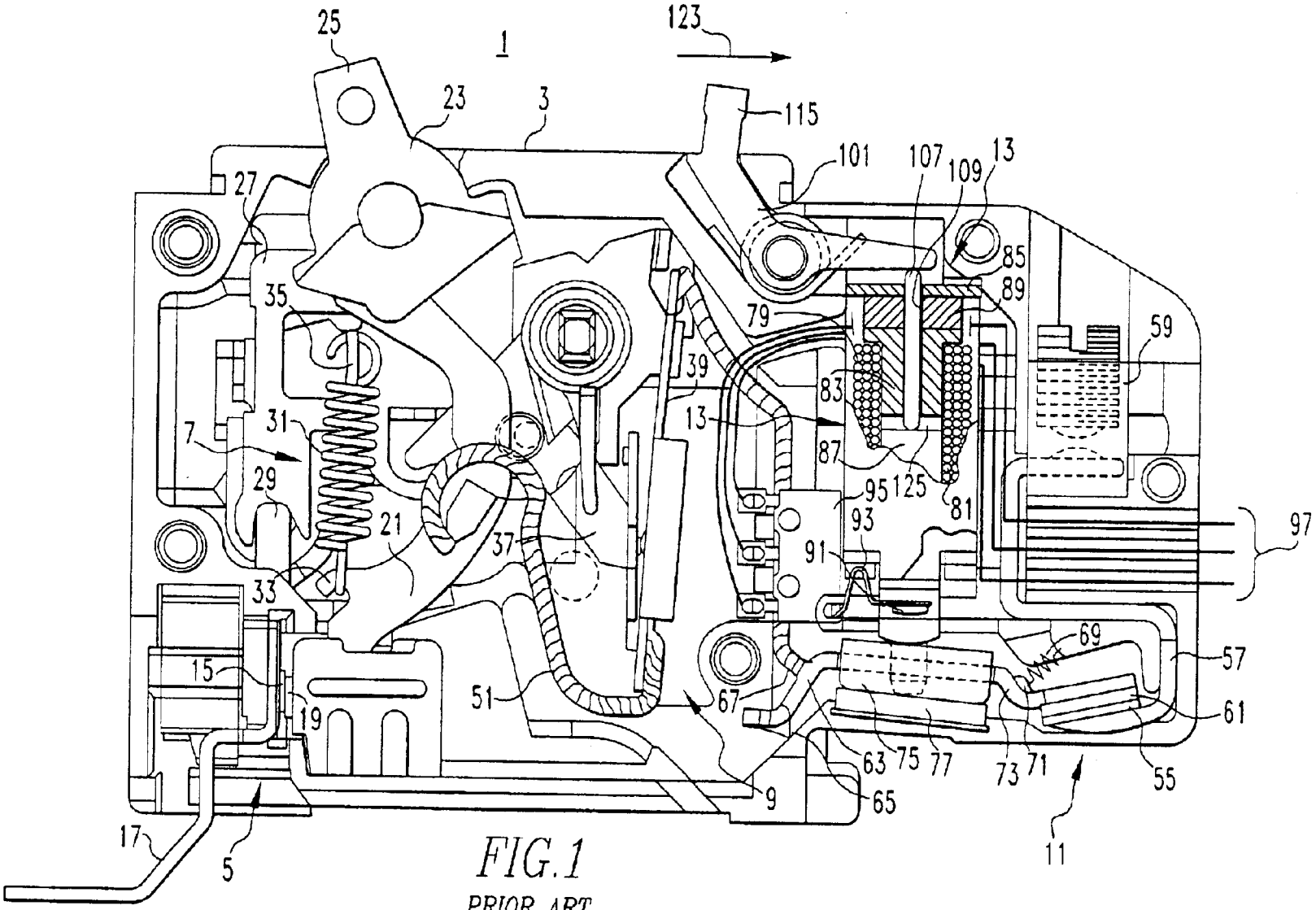
FIG. 1 PRIOR ART
FIG. 1 is an elevational view of a remotely controllable circuit breaker shown with the cover removed and with the main contacts and secondary contacts closed.

The invention will be described as applied to a miniature circuit breaker, although it will become apparent that it could be applied to other types of circuit breakers as well. An example of a miniature remotely controllable circuit breaker is disclosed in U.S. Pat. No. 6,259,339, which is incorporated by reference herein. Referring to FIG. 1, a miniature circuit breaker 1 includes a molded housing 3 with the cover of the housing removed. The basic components of the circuit breaker 1 are a set of main contacts 5, an operating mechanism 7 for opening such main contacts, and a thermal-magnetic trip device 9, which actuates such operating mechanism to trip the set of main contacts 5 open in response to certain overcurrent conditions. Further included are a set of secondary contacts 11 and an actuator 13 in the form of a magnetically latchable solenoid 13, which is remotely controllable to control the open and closed states of the set of secondary contacts 11. Finally, the circuit breaker 1 includes an operating member/indicator member 101, to be described, for manually closing the set of secondary contacts 11 and which also serves as a position indicator to provide a visual indication external to the molded housing 3 of the open/closed state of the set of secondary contacts 11.

The set of main contacts 5 includes a fixed contact 15 secured to a line terminal 17 and a movable main contact 19 affixed to an arcuate movable contact arm 21, which forms part of the operating mechanism 7, for opening and closing such main contacts. The operating mechanism 7 is a well-known device, which includes a pivotally mounted operator 23 with an integrally molded handle 25. The operating mechanism 7 also includes a cradle 27 pivotally mounted on a support 29 molded in the housing 3. With the handle 25 in the closed position, as shown in FIG. 1, a spring 31 connected to a hook 33 on the movable contact arm 21 and a tab 35 on the cradle 27 holds the main contacts 5 closed. The spring 31 also applies a force with the set of main contacts 5 closed, as shown, to the cradle 27 which force tends to rotate such cradle in a clockwise (with respect to FIG. 1) direction about the support 29. However, the cradle 27 has a finger 37, which is engaged by the thermal-magnetic trip device 9 to prevent this clockwise rotation of such cradle under normal operating conditions. Otherwise, as is well-known, the trip device 9 pivots counter-clockwise (with respect to FIG. 1) to unlatch the finger 37 and, thus, the cradle 27, in order to trip open the set of main contacts 5.

The set of secondary contacts 11 includes a fixed secondary contact 55 secured on a load conductor 57, which leads to a load terminal 59. The set of secondary contacts 11 also includes a movable secondary contact 61 fixed to a secondary movable contact arm 63, which at its opposite end is seated in a molded pocket 65 in the molded housing 3. The movable contact arm 63 is electrically connected in series with the set of main contacts 5 by a flexible braided conductor 67 connected to the upper (with respect to FIG. 1) or fixed end of the bimetal 39. The free end of the bimetal 39 is electrically connected to the main movable contact arm 21 by a flexible braided conductor 51. Thus, a circuit for load current is established from the line terminal 17 through the set of main contacts 5, the main movable contact arm 21, the flexible braided conductor 51, the bimetal 39, the flexible braided conductor 67, the secondary movable contact arm 63, the set of secondary contacts 11, and the load conductor 57 to the load terminal 59.

The set of secondary contacts 11 is biased to the closed state of FIG. 1 by a helical compression spring 69 seated on a projection 71 on an offset 73 in the secondary movable contact arm 63. The spring 69 is oriented such that the force that it applies to the movable contact arm 63, which tends to close the set of secondary contacts 11, is relaxed to a degree with such secondary contacts in the open position. This serves the dual purpose of providing the force needed to close the set of secondary contacts 11 against rated current in the protected circuit and, also, reducing the force that must be generated by the magnetically latching solenoid 13 to hold such secondary contacts in the open state. In order for the set of secondary contacts 11 to withstand short circuit currents and allow the set of main contacts 5 to perform the circuit interruption, the magnet force generated by the short circuit current causes a movable armature 75 mounted on the secondary movable contact arm 63 to be attracted to a fixed pole piece 77 seated in the molded housing 3, thereby clamping the set of secondary contacts 11 closed.

The actuator/solenoid 13 includes a first or close coil 79 and a second or open coil 81 concentrically wound on a steel core 83 supported by a steel frame 85. A plunger 87 moves rectilinearly within the coils 79 and 81. A permanent magnet 89 is seated between the steel core 83 and the steel frame 85.

The plunger 87 engages the secondary contact arm 63 to cooperatively form a closing member. When the close coil 79 is energized, a magnetic field is produced to drive the plunger 87 downward to a first position, which rotates the secondary movable contact arm 63 clockwise (with respect to FIG. 1) and thereby moves the set of secondary contacts 11 to the closed state. The set of secondary contacts 11 is maintained in the closed state by the spring 69. When it is desired to open the set of secondary contacts 11, the open coil 81 is energized, which lifts the plunger 87 and with it the secondary movable contact arm 63 to open such secondary contacts. With the plunger 87 in the full upward position of FIG. 2, it contacts the steel core 83 and is retained in this second position by the permanent magnet 89. Subsequently, when the close coil 79 is energized, the magnetic field generated is stronger than the field of the permanent magnet 89 and, therefore, overrides the latter and moves the plunger 87 back to the first, or closed position. A projection 91 on the plunger 87 engages an actuating lever 93 on a microswitch 95, which controls remote operation of the solenoid 13 by signals provided over a remotely operable control circuit represented by control leads 97. As the set of secondary contacts 11 are held closed by the spring 69 and held open by the magnetic latching provided by the permanent magnet 89, only momentary signals are needed to operate such secondary contacts to the open and closed states.

Figure 2:
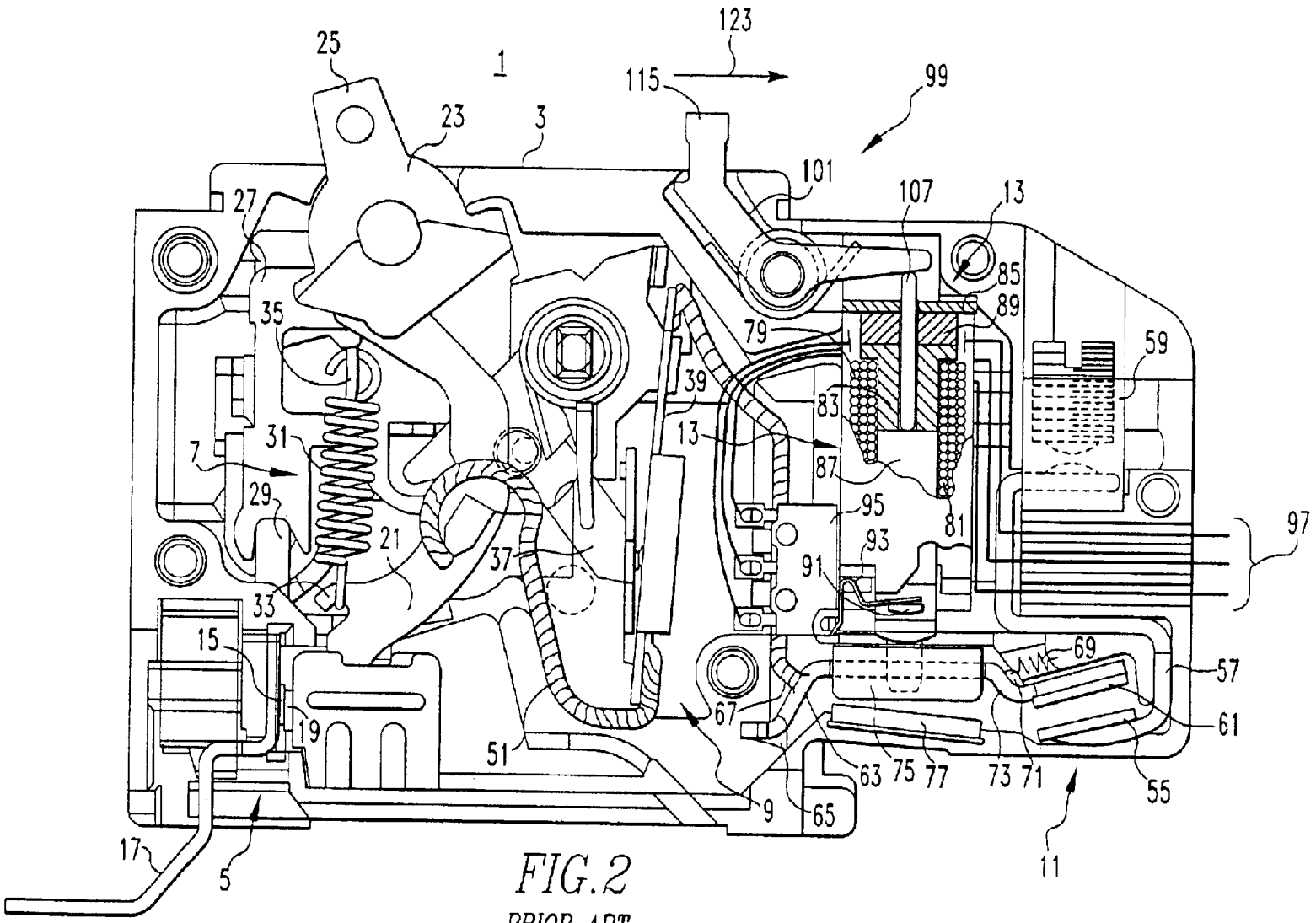
FIG. 2 PRIOR ART
FIG. 2 is a view similar to that of FIG. 1 with the secondary contacts open.

With the set of secondary contacts 11 open, as shown in FIG. 2, an extension 115 can be pushed to the right (with respect to FIG. 2) as shown by the arrow 123, to rotate the operating member/indicator member 101 clockwise (with respect to FIG. 2), thereby depressing a coupling pin 107 and driving the plunger 87 downward to open a gap 125 (as shown in FIG. 1) between the core 83 and the plunger 87, in order that the set of secondary contacts 11 is closed and held closed by the spring 69.

Figure 3:
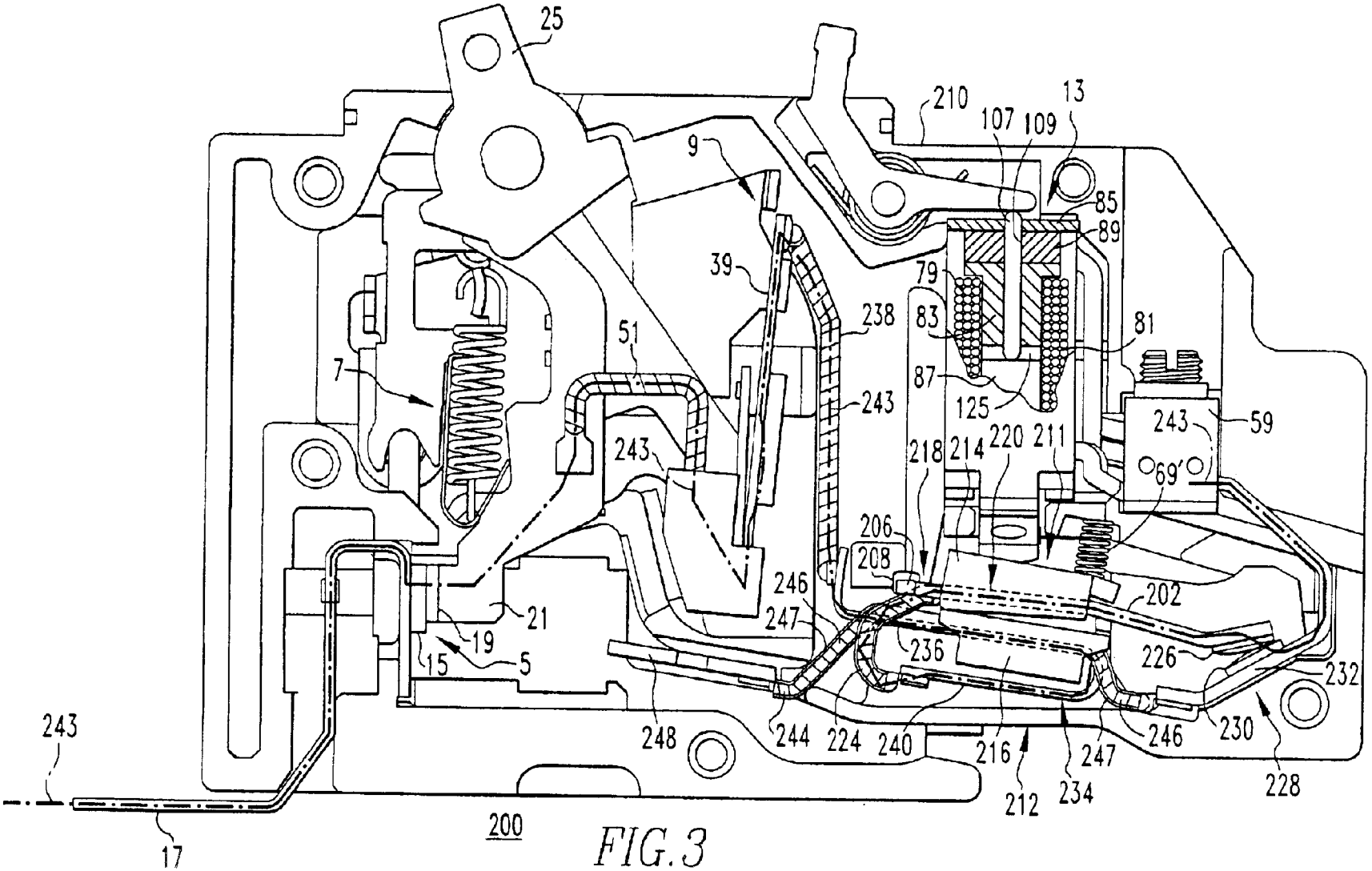
FIG. 3 is an elevational view of a remotely controllable circuit breaker in accordance with the invention shown with the cover removed and with the main contacts and secondary contacts closed.
Figure 5:
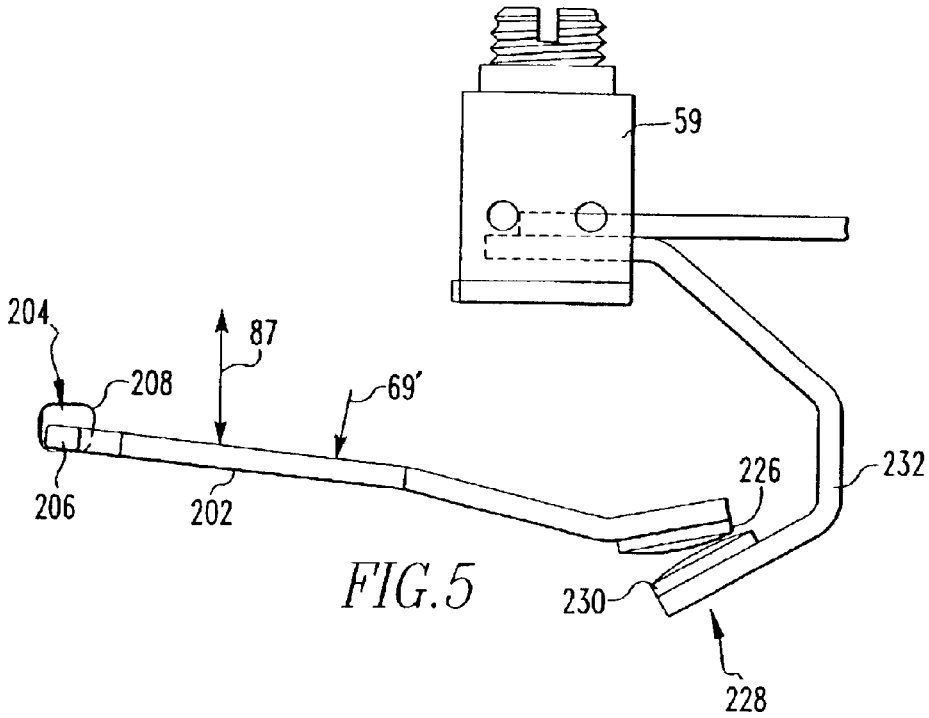
FIG. 5 is a simplified elevational view of the secondary contact arm and secondary contacts of FIG. 3.

Referring to FIG. 3, a remotely controllable circuit breaker 200 in accordance with the present invention is shown. For convenience of disclosure, the circuit breaker 200 includes some of the features of the circuit breaker 1 of FIGS. 1 and 2, which features are shown with common reference numerals, such as, for example, the line terminal 17, the set of main contacts 5, the operating mechanism 7, the bimetal 39, the solenoid 13, and the load terminal 59. As best shown in FIG. 5, the circuit breaker 200 of FIG. 3 includes a secondary movable contact arm 202 having a T-shaped pivot end 204 with two pivot legs 206 (only one is shown) mounted in two corresponding oversized openings 208 (only one is shown) in a molded housing 210. The opening force for the secondary movable contact arm 202 is provided by the plunger 87 of the solenoid 13 of FIG. 3 or by any suitable electric solenoid or motor. Closing force for the secondary movable contact arm 202 may be provided by the plunger 87, and is preferably also provided by spring 69'. An actuator assembly 211 includes the actuator/solenoid 13 and its plunger 87 along with the secondary movable contact arm 202 and the helical compression spring 69', which cooperate to selectively move the set of secondary contacts 228 between the open and closed states.

Figure 4:
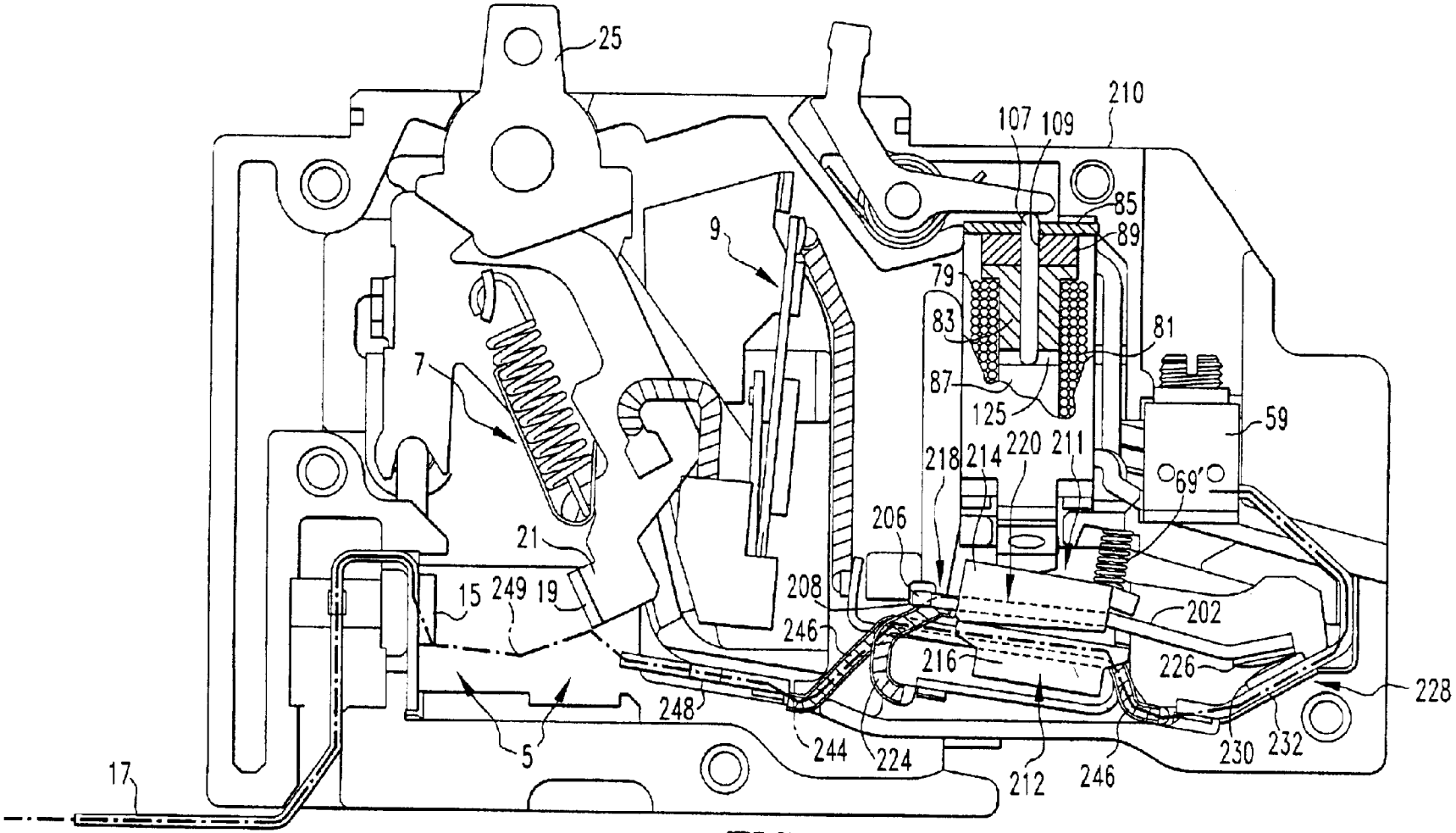
FIG. 4 is a view similar to that of FIG. 3 with the main contacts open.
Figure 6:
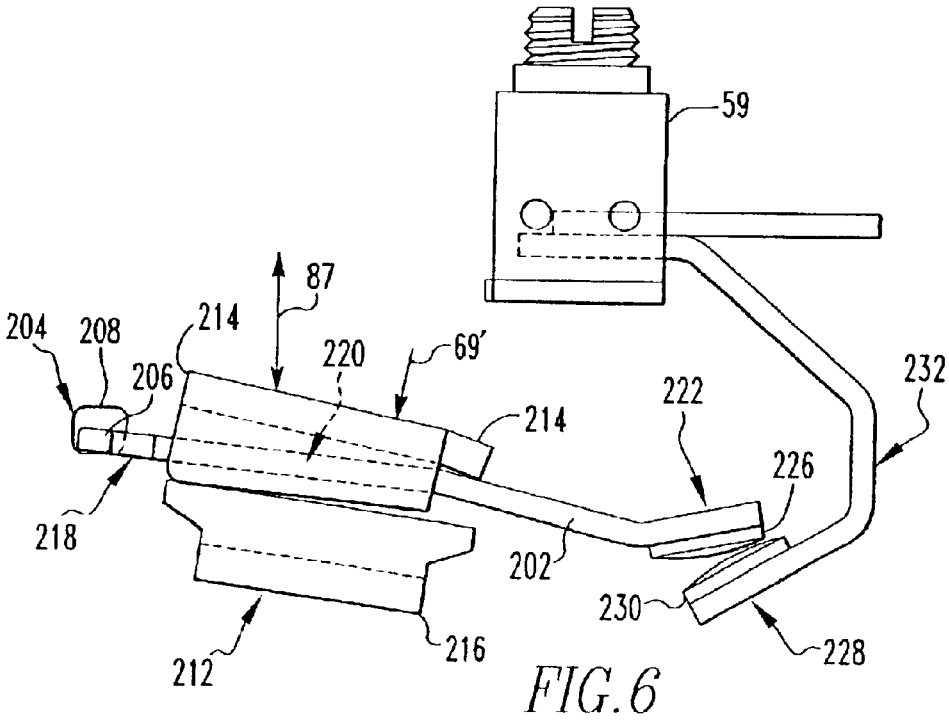
FIG. 6 is a view similar to that of FIG. 5, but also including the fixed and movable armatures of FIG. 3.
Figure 8:
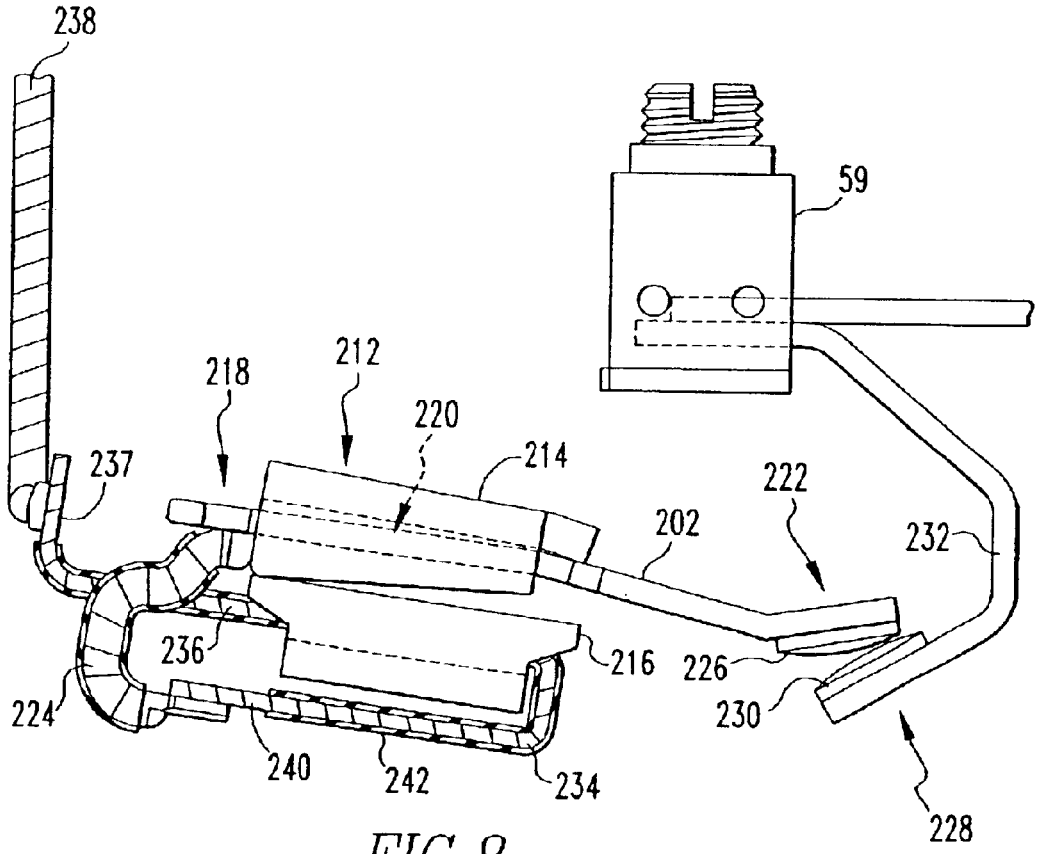
FIG. 8 is a view similar to that of FIG. 6, but also showing the current path of the primary circuit of FIG. 3.

As best shown in FIG. 6, a magnetic armature assembly 212 includes a first or movable magnetic armature 214 coupled to (e.g., suitably mounted on) the secondary movable contact arm 202, and a second or fixed magnetic armature (e.g., pole piece) 216 seated in the molded housing 210 of FIGS. 3 and 4. The secondary movable contact arm 202 includes a first portion 218, an intermediate second portion 220 and a third portion 222. As best shown in FIG. 8, the first portion 218 is electrically connected to a flexible braided conductor 224 (and, in turn, to a current loop 234), the second portion 220 is positioned between the first and second magnetic armatures 214,216, and the third portion 222 is fixed to and carries a movable secondary contact 226. A set of secondary contacts 228 includes the movable secondary contact 226 and a fixed secondary contact 230 secured on a load conductor 232, which leads to the load terminal 59 (FIGS. 3 and 4). As discussed below, this set of magnetic armatures 214,216 is employed to clamp the set of secondary contacts 228 closed during relatively high current conditions, such as a short circuit. These magnetic armatures are U-shaped forms, which wrap around the secondary movable contact arm 202 as best shown in FIGS. 6 and 8.

Continuing to refer to FIG. 8, the exemplary current loop 234 is a solid conductor form (e.g., copper), which raps around the fixed magnetic armature 216. The loop 234 is U-shaped and includes a first leg 236 having a foot 237, which is electrically interconnected with the bimetal 39 (FIGS. 3 and 4) and, thus, with the set of main contacts 5 by a flexible braided conductor 238. The loop 234 also includes a second leg 240, which is electrically interconnected with the secondary movable contact arm 202 and, thus, with the set of secondary contacts 228 by the flexible braided conductor 224. The first leg 236 passes between the first and second magnetic armatures 214,216. Preferably, an insulating or molded barrier 242 insulates the current loop 234 from the magnetic armatures 214,216.

Referring again to FIG. 3, a primary circuit 243 for load current is established from the line terminal 17 through the set of main contacts 5, the main movable contact arm 21, the flexible braided conductor 51, the bimetal 39, the flexible braided conductor 238, the current loop 234, the flexible braided conductor 224, the secondary movable contact arm 202, the set of secondary contacts 228, and the load conductor 232 to the load terminal 59. This primary circuit 243 electrically connects the set of main contacts 5 to the set of secondary contacts 228 between the line and load terminals 17,59. Through the first leg 236 of the current loop 234 and the intermediate second portion 220 of the secondary movable contact arm 202, the primary circuit 243 passes between the first and second magnetic armatures 214,216, which are responsive to a first predetermined condition (e.g., a short circuit or other fault condition) of current flowing therein. Hence, these two turns (i.e., the first current loop leg 236 and the intermediate second portion 220 of the secondary movable contact arm 202) of the primary circuit 243 cooperate with the armatures 214,216 to hold the set of secondary contacts 228 in the closed state during that condition of current, thereby clamping such secondary contacts closed with relatively greater force than that of the known prior art, which employs only a single-turn secondary movable contact arm (e.g., 63 of FIG. 1).

In accordance with an important aspect of the present invention, an alternate or bypass magnetic circuit 244 is provided for arcing current. As shown in FIG. 4, the set of main contacts 5 has just been opened by the operating mechanism 7 in response to a short circuit condition or other fault condition. The alternate circuit 244 includes a flexible braided conductor 246, which is electrically connected between an arc plate 248 and the load conductor 232 and, thus, to the load terminal 59. Preferably, the conductor 246 is insulated by a suitable insulator 247. As is well-known, the arc plate 248 draws an arc 249 from the main fixed contact 15 when the main movable contact arm 21 opens the set of main contacts 5 under short circuit or other fault conditions. An arc chute (not shown) may be employed in the vicinity of the arc 249 and arc plate 248. In the known prior art, the corresponding arcing current is directly diverted to a load terminal without passing between any magnetic armature for secondary contacts. However, a small percentage of current may still conduct through the primary circuit 243 until the arc 249 is extinguished. In accordance with the invention, the alternate circuit 244 passes between the first and second magnetic armatures 214,216, which are responsive to the arcing condition of current flowing in that circuit and which cooperate to hold the set of secondary contacts 228 in the closed state during that arcing condition of current.

In the alternate circuit 244, the arcing current is established from the line terminal 17 through the main fixed contact 15, the arc 249, the arc plate 248, the flexible braided conductor 246, and the load conductor 232 to the load terminal 59. At least initially, the arcing current is about equal to the fault current, although the arcing current is quickly reduced as the arc 249 is quenched. Nevertheless, the corresponding force, as provided by the magnetic armatures 214,216 in response to the arcing current in the alternate circuit 244, continues after the time that the other force, as provided by the magnetic armatures 214,216 in response to the fault current in the primary circuit 243 has ceased as a result of the interruption of that fault current by the separation of the set of main contacts 5. Therefore, these combined forces clamp the set of secondary contacts 228 closed with a relatively greater force and/or for a relatively longer period of time than that of the known prior art, which employs only one circuit through a single-turn secondary movable contact arm (e.g., 63 of FIG. 1).

When the exemplary bypass magnetic circuit 244 is used with the set of main circuit breaker contacts 5, the bypass energy advantageously increases and/or lengthens the duration of the clamping power of the magnetic armatures 214,216. As shown in FIGS. 3 and 4, due to the nature of the alternate circuit 244, a majority of the energy that was passing through the circuit breaker 200 in the primary circuit 243 (FIG. 3) is now redirected from the movable main contact 19, in order to limit the damage under fault current conditions. As the energy decreases in the two turns of the primary circuit 243 (i.e., the first current loop leg 236 and the intermediate second portion 220 of the secondary movable contact arm 202), the corresponding magnetic hold down force on the set of secondary contacts 228 is also decreased. To help minimize that loss, the current path from the bypass magnetic circuit 244 is directed through the magnetic armatures 214,216 as shown in FIG. 4. This increases the magnetic holding force and, at the same time, provides an alternate path for current. This further limits the amount of damage incurred by the set of secondary contacts 228.

Although the flexible braided conductor 246 is shown as being electrically connected to one end of the load conductor 232 and, thus, indirectly to the fixed secondary contact 230, it may alternatively be electrically connected directly to the load terminal 59 or at about the fixed secondary contact 230.

Figure 7:
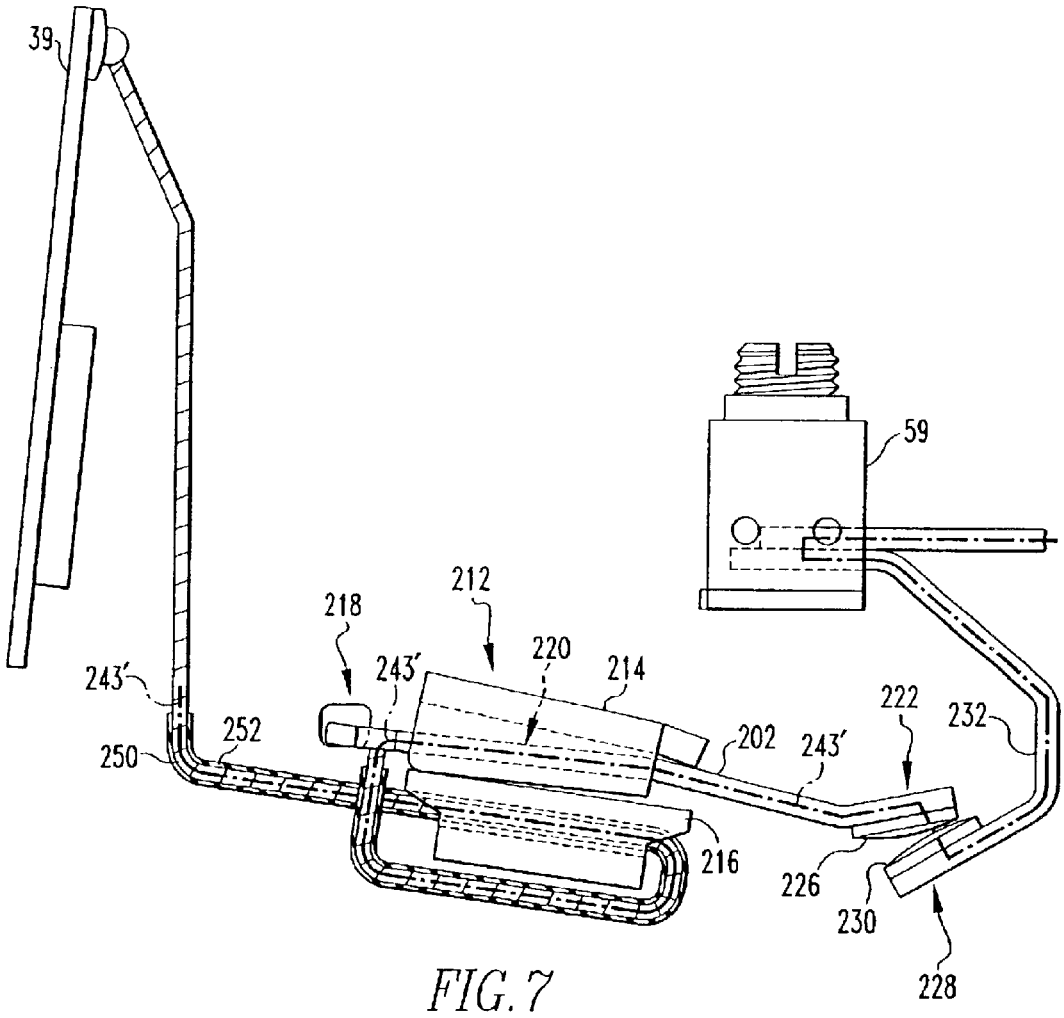
FIG. 7 is a view similar to that of FIG. 6, but also showing the current path of a primary circuit in accordance with an embodiment of the invention.

Referring to FIG. 7, in order to increase the clamping force of the magnetic armatures 214,216, the primary current path in a primary circuit 243' may be routed by one or more loops to provide more "amp-turns". The increased amps-turns increase the magnetic force that the movable armature 214 places on the secondary movable contact arm 202. This force, in turn, increases the contact force of the set of separable contacts 228. Preferably, a flexible braided conductor 250 is electrically connected between the bimetal 39 (as best shown in FIG. 3) and the secondary movable contact arm 202, and passes between the first and second magnetic armatures 214,216 for one or more turns, before being electrically connected to that arm 202. Preferably, a suitable insulating barrier 252 is disposed between that conductor 250 and the first and second magnetic armatures 214,216.

Although the invention has been disclosed in connection with the circuit breaker 200 including the exemplary operating mechanism 7 and thermal-magnetic trip device 9, the invention is applicable to a wide range of circuit breakers employing a wide range of operating mechanisms, with or without an operating member/indicator member, such as 101, and/or trip mechanisms, with or without bimetal conductors, such as 39.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing;

a first terminal;

a second terminal;

a set of first contacts mounted in said housing;

an operating mechanism mounted in said housing and coupled to said set of first contacts for opening and closing said set of first contacts;

an arc plate drawing an arc from one of said first contacts when said operating mechanism opens said set of first contacts;

a set of second contacts mounted in said housing, said set of second contacts having an open state and a closed state, and being electrically interconnected with said set of first contacts between said first and second terminals;

a first circuit electrically connecting said set of first contacts to said set of second contacts;

an actuator mounted in said housing, said actuator selectively moving said set of second contacts between said open and closed states;

a second circuit electrically connected between said arc plate and said second terminal;

a first magnetic armature coupled to said actuator; and a second magnetic armature, said first and second circuits passing between said first and second magnetic armatures, said first magnetic armature and said second magnetic armature responsive to a first predetermined condition of current flowing in said first circuit and cooperating to hold said set of second contacts in said closed state during said first predetermined condition of current flowing in said first circuit, said first magnetic armature and said second magnetic armature responsive to a second predetermined condition of current flowing in said second circuit and cooperating to hold said set of second contacts in said closed state during said second predetermined condition of current flowing in said second circuit.

2. The circuit breaker of claim 1 wherein said first circuit comprises a U-shaped conductor including a first leg electrically interconnected with said set of first contacts and a second leg electrically interconnected with said set of second contacts, with one of said first and second legs passing between said first and second magnetic armatures.

3. The circuit breaker of claim 1 wherein said first circuit comprises a conductor and an insulating barrier between said conductor and said first and second magnetic armatures.

4. The circuit breaker of claim 1 wherein said actuator comprises a solenoid including a plunger movable to a first position in which said set of second contacts is in said open state and a second position in which said set of second contacts is in said closed state.

5. The circuit breaker of claim 1 wherein said set of second contacts includes a fixed contact and a movable contact; and wherein said actuator comprises a movable arm carrying said movable contact.

6. The circuit breaker of claim 5 wherein said second circuit comprises a conductor electrically interconnected between said arc plate and said fixed contact; and wherein said fixed contact is electrically connected to said second terminal.

7. The circuit breaker of claim 5 wherein said first circuit comprises a flexible conductor electrically interconnected with said set of first contacts and electrically connected to said movable arm.

8. The circuit breaker of claim 1 wherein said set of first contacts comprises a fixed contact electrically connected to said first terminal and a movable contact; and wherein said operating mechanism comprises a movable arm carrying said movable contact.

9. The circuit breaker of claim 8 wherein said arc plate draws said arc from said fixed contact when said movable arm opens said set of first contacts.

10. The circuit breaker of claim 8 wherein said movable arm is a first movable arm; wherein said fixed contact is a first fixed contact; wherein said movable contact is a first movable contact; wherein said set of second contacts includes a second fixed contact and a second movable contact; wherein said actuator comprises a second movable arm carrying said second movable contact; wherein said first circuit comprises a first flexible conductor electrically connected to said first movable arm, an intermediate conductor electrically connected to said first flexible conductor, and a second flexible conductor electrically connected between said intermediate conductor and said second movable arm.

11. The circuit breaker of claim 10 wherein said intermediate conductor is a bimetal.

12. The circuit breaker of claim 10 wherein said second flexible conductor passes from said intermediate conductor and between said first and second magnetic armatures before being electrically connected to said second movable arm.

13. The circuit breaker of claim 12 wherein said second movable arm includes a first portion, a second portion and a third portion, said second portion being between said first and second portions, said first portion being electrically connected to said second flexible conductor, said second portion being between said first and second magnetic armatures, and said third portion carrying said second movable contact.

14. The circuit breaker of claim 8 wherein said movable arm is a first movable arm; wherein said fixed contact is a first fixed contact; wherein said movable contact is a first movable contact; wherein said set of second contacts includes a second fixed contact and a second movable contact; wherein said actuator comprises a second movable arm carrying said second movable contact; and wherein said first circuit comprises at least one conductor electrically connected between said first movable arm and said second movable arm.

15. The circuit breaker of claim 14 wherein said second movable arm includes a first portion, a second portion and a third portion, said second portion being between said first and second portions, said first portion being electrically connected to said at least one conductor, said second portion being between said first and second magnetic armature, and said third portion carrying said second movable contact.

16. The circuit breaker of claim 14 wherein one of said at least one conductor is a flexible conductor, which passes between said first and second magnetic armatures before being electrically connected to said second movable arm.

17. The circuit breaker of claim 14 wherein said first circuit further comprises a flexible conductor, which is electrically interconnected with said first movable arm, and a U-shaped conductor including a first leg electrically connected to said flexible conductor and a second leg electrically interconnected with said second movable arm, with one of said first and second legs passing between said first and second magnetic armature.

18. The circuit breaker of claim 1 wherein said first circuit comprises a conductor and an insulating barrier between said conductor and said first and second magnetic armatures.

19. The circuit breaker of claim 1 wherein said second circuit comprises a first conductor and a second flexible conductor, said second flexible conductor being electrically connected between said arc plate and said first conductor, said first conductor being electrically connected to said second terminal.

20. A remotely controllable circuit breaker comprising:

a housing;

a first terminal;

a second terminal;

a set of first contacts mounted in said housing;

an operating mechanism mounted in said housing and coupled to said set of first contacts for opening and closing said set of first contacts;

an arc plate drawing an arc from one of said first contacts when said operating mechanism opens said set of first contacts;

a set of second contacts mounted in said housing, said set of second contacts having an open state and a closed state, and being electrically interconnected with said set of first contacts between said first and second terminals;

a first circuit electrically connecting said set of first contacts to said set of second contacts;

a remotely controllable solenoid including a member coupled to said set of second contacts, said member movable to a first position in which said set of second contacts is in said open state and a second position in which said set of second contacts is in said closed state;

a second circuit electrically connected between said arc plate and said second terminal;

a first magnetic armature coupled to said member; and a second magnetic armature, said first and second circuits passing between said first and second magnetic armatures, said first magnetic armature and said second magnetic armature responsive to a first predetermined condition of current flowing in said first circuit and cooperating to hold said set of second contacts in said closed state during said first predetermined condition of current flowing in said first circuit, said first magnetic armature and said second magnetic armature responsive to a second predetermined condition of current flowing in said second circuit and cooperating to hold said set of second contacts in said closed state during said second predetermined condition of current flowing in said second circuit.

21. The remotely controllable circuit breaker of claim 20 wherein said first predetermined condition of current is about equal to said second predetermined condition of current.

22. The remotely controllable circuit breaker of claim 20 wherein said second circuit comprises a first conductor and a second flexible conductor, said second flexible conductor being electrically connected between said arc plate and said first conductor, said first conductor being electrically connected to said second terminal.

23. A circuit breaker comprising:

a housing;

a first terminal;

a second terminal;

a set of first contacts mounted in said housing;

an operating mechanism mounted in said housing and coupled to said set of first contacts for opening and closing said set of first contacts;

a set of second contacts mounted in said housing, said set of second contacts having an open state and a closed state, and being electrically interconnected with said set of first contacts between said first and second terminals;

a circuit electrically connecting said set of first contacts to said set of second contacts;

an actuator mounted in said housing, said actuator selectively moving said set of second contacts between said open and closed states;

a first magnetic armature coupled to said actuator; and a second magnetic armature, with said circuit passing between said first and second magnetic armatures for at least two turns, said first magnetic armature and said second magnetic armature responsive to a predetermined condition of current flowing in said circuit and cooperating to hold said set of second contacts in said closed state during said predetermined condition of current flowing in said circuit.

24. The circuit breaker of claim 23 wherein said circuit comprises a flexible conductor and U-shaped conductor including a first leg electrically interconnected with said set of first contacts and a second leg, with one of said first and second legs passing between said first and second magnetic armatures; wherein said set of second contacts includes a fixed contact and a movable contact; wherein said actuator comprises a movable arm carrying said movable contact; wherein said flexible conductor is electrically connected between said second leg and said movable arm; and wherein said movable arm passes between said first and second magnetic armatures.

* * * * *